US011903411B2

(12) United States Patent
Lee et al.

(10) Patent No.: US 11,903,411 B2
(45) Date of Patent: Feb. 20, 2024

(54) AEROSOL GENERATING ARTICLE INCLUDING A PLURALITY OF FLAVORING CAPSULES

(71) Applicant: KT&G CORPORATION, Daejeon (KR)

(72) Inventors: Seung Won Lee, Gwangmyeong-si (KR); Sang Kyu Park, Hwaseong-si (KR)

(73) Assignee: KT&G CORPORATION, Daejeon (KR)

( * ) Notice: Subject to any disclaimer, the term of this patent is extended or adjusted under 35 U.S.C. 154(b) by 835 days.

(21) Appl. No.: 16/971,524

(22) PCT Filed: Oct. 23, 2019

(86) PCT No.: PCT/KR2019/013990
§ 371 (c)(1),
(2) Date: Aug. 20, 2020

(87) PCT Pub. No.: WO2020/116777
PCT Pub. Date: Jun. 11, 2020

(65) Prior Publication Data

US 2020/0397035 A1 Dec. 24, 2020

(30) Foreign Application Priority Data

Dec. 5, 2018 (KR) ..... 10-2018-0155460

(51) Int. Cl.
*A24F 40/20* (2020.01)
*A24F 40/465* (2020.01)
(Continued)

(52) U.S. Cl.
CPC ..... *A24D 1/20* (2020.01); *A24D 3/061* (2013.01); *A24D 3/10* (2013.01); *A24D 3/17* (2020.01); *A24F 40/20* (2020.01); *A24F 40/465* (2020.01)

(58) Field of Classification Search
CPC ..... A24F 40/20; A24F 40/465; A24D 1/20; A24D 3/06; A24D 3/061; A24D 3/10; A24D 3/17; H05B 6/10
See application file for complete search history.

(56) References Cited

U.S. PATENT DOCUMENTS 9,717,277 B2 * 8/2017 Mironov ..... H05B 6/108
10,912,329 B2 2/2021 Apetrei Birza
(Continued)

FOREIGN PATENT DOCUMENTS

CN 204949521 U 1/2016
CN 105307526 A 2/2016
(Continued)

OTHER PUBLICATIONS

Office Action dated Dec. 15, 2022 from the Chinese Patent Office in Application No. 201980016867.7.
(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

Provided is an aerosol generating article including a plurality of flavoring capsules arranged inside at least one of a tobacco medium section and a filter section, wherein the plurality of flavoring capsules respectively include different flavor sources and respectively include susceptor materials configured to be heated at different rates as an alternating magnetic field passes through the susceptor materials.

11 Claims, 9 Drawing Sheets

(51) Int. Cl.

| | |
|---|---|
| ***A24D 1/20*** | (2020.01) |
| ***A24D 3/17*** | (2020.01) |
| ***A24D 3/06*** | (2006.01) |
| ***A24D 3/10*** | (2006.01) |

(56) References Cited

U.S. PATENT DOCUMENTS

| | | | | |
|---|---|---|---|---|
| 2013/0276803 | A1 | 10/2013 | Saito et al. | |
| 2016/0150825 | A1* | 6/2016 | Mironov | A24F 40/46 219/634 |
| 2017/0071250 | A1* | 3/2017 | Mironov | A24F 40/465 |
| 2017/0079326 | A1* | 3/2017 | Mironov | H05B 6/108 |
| 2018/0007974 | A1* | 1/2018 | Thorens | A61M 15/003 |
| 2018/0116277 | A1* | 5/2018 | Besso | A61K 8/347 |
| 2018/0140015 | A1 | 5/2018 | Carroll et al. | |
| 2018/0271153 | A1* | 9/2018 | John | A24F 40/42 |
| 2018/0295885 | A1 | 10/2018 | Rojo-Calderon et al. | |
| 2018/0317286 | A1 | 11/2018 | Rojo-Calderon et al. | |
| 2018/0332894 | A1 | 11/2018 | Gill et al. | |
| 2019/0045837 | A1 | 2/2019 | Spencer | |
| 2019/0053535 | A1 | 2/2019 | Apetrei Birza | |
| 2019/0053541 | A1 | 2/2019 | Rojo-Calderon | |
| 2019/0320720 | A1* | 10/2019 | Mironov | H05B 6/108 |
| 2020/0086068 | A1* | 3/2020 | Lee | A61M 11/042 |

FOREIGN PATENT DOCUMENTS

| | | | |
|---|---|---|---|
| CN | 207202048 | U | 4/2018 |
| CN | 108135276 | A | 6/2018 |
| CN | 108135277 | A | 6/2018 |
| CN | 108135282 | A | 6/2018 |
| CN | 108617042 | A | 10/2018 |
| CN | 108697171 | A | 10/2018 |
| EP | 2 625 974 | A1 | 8/2013 |
| EP | 3 075 266 | A1 | 10/2016 |
| EP | 3393283 | B1 | 2/2020 |
| KR | 10-2015-0143877 | A | 12/2015 |
| KR | 10-2015-0143885 | A | 12/2015 |
| KR | 10-1648324 | B1 | 8/2016 |
| KR | 10-1656639 | B1 | 9/2016 |
| KR | 10-2017-0107550 | A | 9/2017 |
| KR | 10-2017-0140193 | A | 12/2017 |
| KR | 10-2018-0072758 | A | 6/2018 |
| KR | 10-2018-0091835 | A | 8/2018 |
| KR | 10-2018-0111460 | A | 10/2018 |
| WO | 2017/068096 | A1 | 4/2017 |
| WO | 2017/198874 | A1 | 11/2017 |
| WO | 2017/207586 | A1 | 12/2017 |

OTHER PUBLICATIONS

International Search Report for PCT/KR2019/013990 dated Jan. 29, 2020 (PCT/ISA/210).

Communication dated Jan. 19, 2021, issued by the Korean Intellectual Property Office in Korean Application No. 10-2018-0155460.

Communication dated May 25, 2021, from the Japanese Patent Office in application No. 2020536625.

Extended European Search Report dated Nov. 12, 2021 in European Application No. 19893589.2.

* cited by examiner

AEROSOL GENERATING ARTICLE INCLUDING A PLURALITY OF FLAVORING CAPSULES

CROSS REFERENCE TO RELATED APPLICATIONS

This application is a National Stage of International Application No. PCT/KR2019/013990 filed Oct. 23, 2019, claiming priority based on Korean Patent Application No. 10-2018-0155460 filed Dec. 5, 2018.

TECHNICAL FIELD

The present disclosure relates to an aerosol generating article and an aerosol generating device used with the same.

BACKGROUND ART

Recently, the demand for alternative methods of overcoming the shortcomings of general cigarettes has increased. For example, there is growing demand for a method of generating an aerosol by heating an aerosol generating material in a cigarette, rather than by combusting cigarettes. Accordingly, studies on heating-type cigarettes or heating-type aerosol generating devices have been actively conducted.

In existing heating-type aerosol generating articles, in order to provide a user with an additional flavor or taste, a flavoring component is added to a tobacco medium section or a flavoring capsule is arranged in a filter section. However, when the flavoring component is added to the tobacco medium section, the user tastes the same flavor from the beginning to the end of smoking because the flavor does not change over time. Also, when the flavoring capsule is arranged in the filter section, the user has to manually crash the flavoring capsule to change a flavor. Therefore, there is a need for a technique for providing a user with various flavors without an additional inconvenience when the user smokes using a heating-type aerosol generating device accommodating a heating-type aerosol generating article.

DESCRIPTION OF EMBODIMENTS

Solution to Problem

Provided are an aerosol generating article and an aerosol generating device used with the same. According to an aspect of the present disclosure, an aerosol generating article may include: a tobacco medium section; a filter section coupled to a downstream end of the tobacco medium section; and a plurality of flavoring capsules arranged inside at least one of the tobacco medium section and the filter section, wherein the plurality of flavoring capsules respectively include different flavor sources and respectively include susceptor materials configured to be heated at different rates as an alternating magnetic field passes through the susceptor materials. The technical problems to be solved according to the present disclosure are not limited to the technical problems as described above, and other technical problems may be inferred from the following embodiments.

Advantageous Effects of Disclosure

The present disclosure may provide an aerosol generating article and an aerosol generating device used with the same. In detail, an aerosol generating article according to the present disclosure may include a plurality of flavoring capsules including different flavor sources and include susceptor materials heated at different rates as an alternating magnetic field passes through the susceptor materials. As the susceptor materials respectively included in the plurality of flavoring capsules are heated at different rates, the plurality of flavoring capsules reach a preset temperature at different times, and the flavoring sources are discharged from the plurality of flavoring capsules at different times. Therefore, a user may feel various flavors changing with time without inconvenience of manually bursting a flavoring capsule.

According to the present disclosure, provided may be an induction heating-type aerosol generating device used with an aerosol generating article to heat susceptor materials respectively included in a plurality of flavoring capsules. The aerosol generating device according to the present disclosure may include an induction coil that surrounds an accommodation space, extending to positions where the plurality of flavoring capsules included in the aerosol generating article are arranged when the aerosol generating article is accommodated in the accommodation space, thereby heating the susceptor materials respectively included in the plurality of flavoring capsules.

BEST MODE

Figure 1:
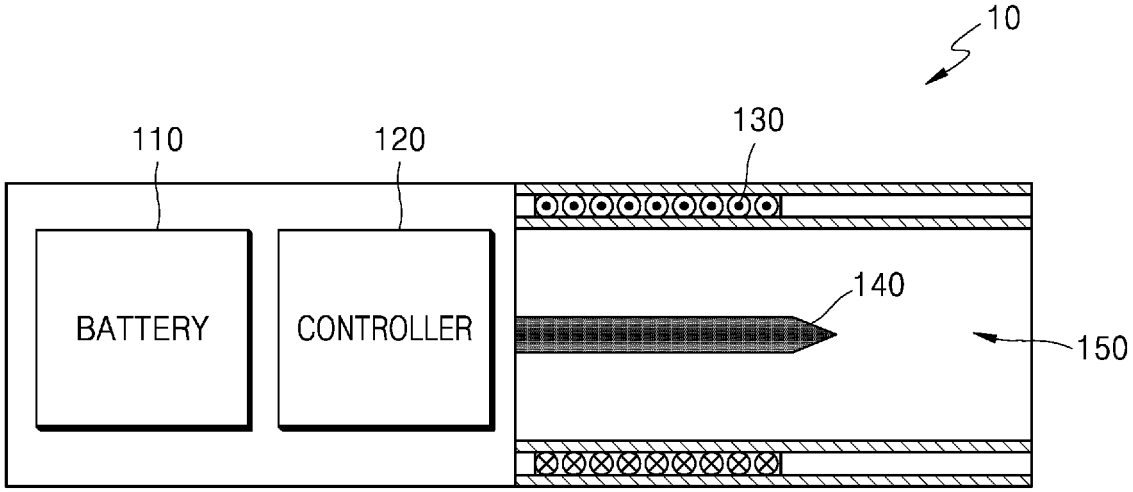
FIG. 1 is a view illustrating a configuration of an aerosol generating device according to some embodiments.

According to an aspect of the present disclosure, an aerosol generating article may include: a tobacco medium section; a filter section coupled to a downstream end of the tobacco medium section; and a plurality of flavoring capsules arranged inside at least one of the tobacco medium section and the filter section, wherein the plurality of flavoring capsules respectively include different flavor sources and respectively include susceptor materials configured to be heated at different rates as an alternating magnetic field passes through the susceptor materials.

The first susceptor material included in a first flavoring capsule is different from a second susceptor material included in a second flavoring capsule, among the plurality of flavoring capsules, in terms of at least one of type, density, weight, volume, area, thickness and shape, such that the first susceptor material and the second susceptor material may have different heating rates.

The plurality of flavoring capsules may respectively include the susceptor materials that are coated or applied on at least a portion of outer surfaces of the plurality of flavoring capsules.

The plurality of flavoring capsules may respectively include the susceptor materials in the form of particles inside the plurality of flavoring capsules.

The plurality of flavoring capsules may burst and discharge the flavor sources when heated to a preset temperature or greater by the susceptor materials.

A first flavoring capsule among the plurality of flavoring capsules may be arranged further downstream than a second flavoring capsule having a lower heating rate than the first flavoring capsule.

The filter section may include: a first filter segment including a hollow inside; a cooling segment coupled to a downstream end of the first filter segment; and a second filter segment coupled to a downstream end of the cooling segment, wherein at least one of the plurality of flavoring capsules is arranged in the hollow of the first filter segment.

The first filter segment may further include at least one air flow passage penetrating from an upstream end of the first filter segment to an downstream end of the first filter segment, in addition to the hollow in which the at least one of the plurality of flavoring capsules is arranged.

The filter section may include: a first filter segment including cellulose acetate tow; a second filter segment coupled to a downstream end of the first filter segment and including a first hollow inside; a cooling segment coupled to a downstream end of the second filter segment and including therein a second hollow having a greater diameter than the first hollow; and a third filter segment coupled to a downstream end of the cooling segment, wherein at least one of the plurality of flavoring capsules is arranged inside the first filter segment.

According to another aspect of the present disclosure, an aerosol generating device may be used with an aerosol generating article and may include: an accommodation space accommodating the aerosol generating article; an induction coil arranged to surround at least a portion of the accommodation space; a battery supplying power to the induction coil to enable the induction coil to generate an alternating magnetic field; and a heater which is arranged at an inner end of the accommodation space and heats up as the alternating magnetic field generated from the induction coil passes through the heater.

The induction coil may extend to a position where a plurality of flavoring capsules included in the aerosol generating article accommodated in the accommodation space are arranged, to thereby surround the accommodation space.

Mode of Disclosure

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and may be implemented by hardware components or software components and combinations thereof.

The terms "upstream" and "downstream" may be determined on the basis of a direction in which air flows when a user smokes using an aerosol generating article. For example, when a user smokes using an aerosol generating article illustrated in FIG. 2, an aerosol generated in a tobacco medium section 210 moves to a filter section 220 along air introduced from the outside and is delivered to the user through the filter section 220. Therefore, the tobacco medium section 210 is located upstream of the filter section 220. It will be easily understood by one of ordinary skill in the art that the terms "upstream" and "downstream" may be relative according to a relationship between components.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a view illustrating a configuration of an aerosol generating device according to some embodiments.

Referring to FIG. 1, an aerosol generating device 10 includes a battery 110, a controller 120, an induction coil 130, and a heater 140. Also, an aerosol generating article 20, 30, or 80 may be inserted into an accommodation space 150 provided in the aerosol generating device 10.

The aerosol generating device 10 illustrated in FIG. 1 only shows some components related to the present embodiment. Therefore, it will be understood by one of ordinary skill in the art related to the present embodiment that other general-purpose components may be further included in the aerosol generating device 10, in addition to the components illustrated in FIG. 1.

FIG. 1 illustrates that the battery 110, the controller 120, and the heater 140 are arranged in series, and the induction coil 130 is arranged to surround the heater 140 and the accommodation space 150, but embodiments are not limited thereto. In other words, according to the design of the aerosol generating device 10, the battery 110, the controller 120, the induction coil 130, and the heater 140 may be differently arranged.

When the aerosol generating article 20, 30, or 80 is inserted into the aerosol generating device 10, the aerosol generating device 10 may supply power to the induction coil 130 to enable the induction coil 130 to generate an alternating magnetic field. The alternating magnetic field generated by the induction coil 130 may pass through the heater 140 to thereby heat the heater 140. As a temperature of an aerosol generating material in the aerosol generating article 20, 30, or 80 is raised by the heated heater 140, an aerosol may be generated. The generated aerosol is delivered to the user through the aerosol generating article 20, 30, or 80.

As needed, even when the aerosol generating article 20, 30, or 80 is not inserted into the aerosol generating device 10, the aerosol generating device 10 may heat the heater 140 by using the induction coil 130.

The battery 110 supplies power to be used for the aerosol generating device 10 to operate. For example, the battery 110 may supply power to enable the induction coil 130 to generate the alternating magnetic field or may supply power for operating the controller 120. Also, the battery 110 may supply power for operating a display, a sensor, a motor, or the like installed in the aerosol generating device 10.

The controller 120 controls an overall operation of the aerosol generating device 10. In detail, the controller 120 controls not only operations of the battery 110 and the induction coil 130 but also operations of other components included in the aerosol generating device 10. Also, the controller 120 determines whether or not the aerosol generating device 10 is able to operate by checking a state of each component of the aerosol generating device 10.

The controller 120 includes at least one processor. A processor may be implemented by an array of a plurality of logic gates or may be implemented by a combination of a general-purpose microprocessor and a memory in which a program executable in the microprocessor is stored. It will be understood by one of ordinary skill in the art that the processor may be implemented by other forms of hardware.

The induction coil 130 may be an electrically conductive coil that generates an alternating magnetic field by power supplied from the battery 110. The induction coil 130 may be arranged to surround at least a portion of the accommodation space 150. The alternating magnetic field generated by the induction coil 130 may be applied to the heater 140 arranged at an inner end of the accommodation space 150.

The heater 140 may include a susceptor that is heated as the alternating magnetic field generated from the induction coil 130 passes through the susceptor. The susceptor may include metal or carbon. For example, the susceptor may include at least one of ferrite, a ferromagnetic alloy, stainless steel, and aluminum.

Also, the susceptor may include at least one of graphite, molybdenum, silicon carbide, niobium, a nickel alloy, a metal film, ceramic such as zirconia, transition metal such as nickel (Ni) or cobalt (Co), and metalloid such boron (B) or phosphorus (P). However, the susceptor included in the heater 140 is not limited to the example described above and may include any susceptors that may be heated to a desired temperature by an alternating magnetic field applied thereto. Here, the desired temperature may be preset in the aerosol generating device 10 or may be set by a user.

When the aerosol generating article 20, 30, or 80 is inserted into the aerosol generating device 10, the heater 140 may be located inside the aerosol generating article 20, 30, or 80. Therefore, the heated heater 140 may raise the temperature of the aerosol generating material in the aerosol generating article 20, 30, or 80.

FIG. 1 illustrates that the heater 140 is arranged to be inserted into the aerosol generating article 20, 30, or 80, but is not limited thereto. For example, the heater 140 may include a tube-type heating element, a plate-type heating element, a needle-type heating element, or a rod-type heating element. The heater 140 may heat an inside or outside of the aerosol generating article 20, 30, or 80 according to the shape of the heating element. Also, the heater 140 may be fixed in the aerosol generating device 10. but is not limited thereto. Thus, the heater 140 may be detachable from the aerosol generating device 10.

Also, a plurality of heaters 140 may be arranged in the aerosol generating device 10. Here, the plurality of heaters 140 may be arranged to be inserted into the aerosol generating article 20, 30, or 80 or may be arranged outside the aerosol generating article 20, 30, or 80. Also, some of the plurality of heaters 140 may be arranged to be inserted into the aerosol generating article 20, 30, or 80, and the others may be arranged outside the aerosol generating article 20, 30, or 80. In addition, the shape of the heater 140 is not limited to the shape illustrated in FIG. 1, and may be manufactured in various shapes.

The aerosol generating device 10 may further include general-purpose components in addition to the battery 110, the controller 120, the induction coil 130, and the heater 140. For example, the aerosol generating device 10 may include a display capable of outputting visual information and/or a motor for outputting tactile information. Also, the aerosol generating device 10 may include at least one sensor (a puff detecting sensor, a temperature detecting sensor, an aerosol generating article insertion detecting sensor, or the like).

In addition, the aerosol generating device 10 may be manufactured in a structure that allows external air to be introduced or allows internal air to be discharged, even when the aerosol generating article 20, 30, or 80 is inserted in the aerosol generating device 10.

Although not illustrated in FIG. 1, the aerosol generating device 10 may constitute a system with an additional cradle. For example, the cradle may be used for charging the battery 110 of the aerosol generating device 10. Alternatively, the heater 140 may be heated when the cradle is coupled to the aerosol generating device 10.

The aerosol generating article 20, 30, or 80 may be similar to a general combustive cigarette. For example, the aerosol generating article 20, 30, or 80 may be divided into a first portion including an aerosol generating material and a second portion including a filter and the like. Alternatively, the second portion of the aerosol generating article 20, 30, or 80 may also include an aerosol generating material. For example, an aerosol generating material made in the form of granules or capsules may be inserted into the second portion.

The entire first portion may be inserted into the aerosol generating device 10, and the second portion may be exposed to the outside. Alternatively, a portion of the first portion may be inserted into the aerosol generating device 10. Otherwise, the first portion and the second portion may be partially inserted into the aerosol generating device 10. The user may puff the aerosol while holding the second portion by the mouth of the user. Here, an aerosol is generated as external air passes through the first portion, and the generated aerosol is delivered to the mouth of the user by passing through the second portion.

For example, external air may be introduced through at least one air passage formed in the aerosol generating device 10. For example, opening and closing of the air passage and/or a size of the air passage may be adjusted by the user. As such, the amount and quality of smoke may be adjusted by the user. As another example, external air may flow into the aerosol generating article 20, 30, or 80 through at least one hole formed in a surface of the aerosol generating article 20, 30, or 80.

Hereinafter, an example of a basic structure of an aerosol generating article will be described with reference to FIG. 2.

Figure 2:
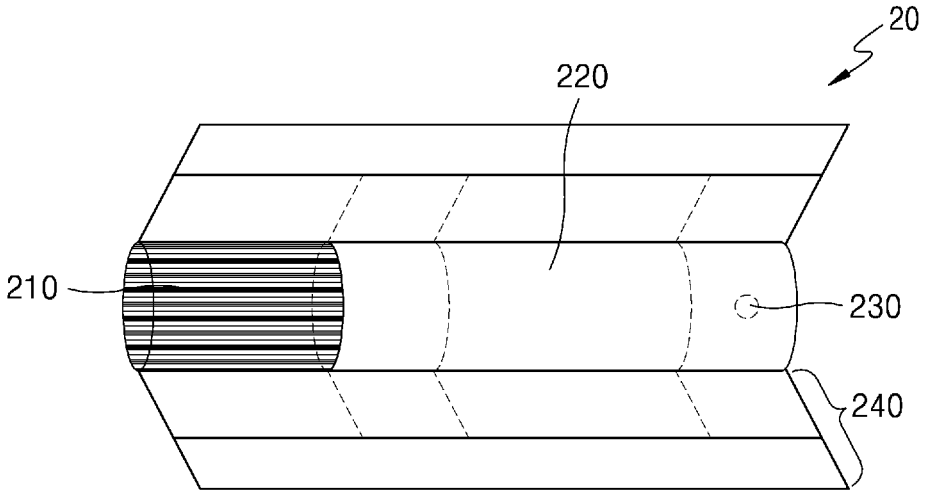
FIG. 2 is a view illustrating a basic structure of an aerosol generating article according to some embodiments.

FIG. 2 is a view illustrating a basic structure of an aerosol generating article according to some embodiments.

Referring to FIG. 2, the aerosol generating article 20 includes a tobacco medium section 210 and a filter section 220 coupled to a downstream end of the tobacco medium section 210. The first portion described above with reference to FIG. 1 includes the tobacco medium section 210, and the second portion includes the filter section 220.

FIG. 2 illustrates that the filter section 220 consists of a single segment, but it is not limited thereto. In other words, the filter section 220 may also include a plurality of segments. For example, the filter section 220 may include a cooling segment cooling an aerosol and a filter segment filtering certain component included in the aerosol. Also, as needed, the filter section 220 may further include at least one segment performing other functions.

The aerosol generating article 20 may be packaged by at least one wrapper 240. The wrapper 240 may have at least one hole through which external air may be introduced or internal air may be discharged. As an example, the aerosol generating article 20 may be packaged by one wrapper 240. As another example, the aerosol generating article 20 may be double-packaged by two or more wrappers 240. For example, the tobacco medium section 210 may be packaged by a first wrapper, and the filter section 220 may be packaged by a second wrapper. Also, the tobacco medium section 210 and the filter section 220 that are packaged by separate wrappers may be coupled to each other, and the entire aerosol generating article 20 may be repackaged by a third wrapper. When each of the tobacco medium section 210 and the filter section 220 includes a plurality of segments, the segments may be respectively packaged by separate wrappers. Also, the entire aerosol generating article 20 in which the segments packaged by the separate wrappers are coupled to each other may be repackaged by another wrapper.

The tobacco medium section 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but is not limited thereto. Also, the tobacco medium section 210 may include other additives such as flavors, a wetting agent, and/or organic acid. Also, the tobacco medium section 210 may include a flavored liquid, such as menthol or a moisturizer, which is injected to the tobacco medium section 210.

The tobacco medium section 210 may be manufactured in various forms. For example, the tobacco medium section 210 may be formed using a sheet or strands. Also, the tobacco medium section 210 may be formed as a pipe tobacco which is formed of tiny bits cut from a tobacco sheet. In addition, the tobacco medium section 210 may be surrounded by a heat conductive material. For example, the heat-conducting material may be, but is not limited to, metal foil such as aluminum foil. For example, the heat conductive material surrounding the tobacco medium section 210 may increase heat conductivity of the tobacco medium section 210 by uniformly distributing heat transferred to the tobacco medium section 210, thereby improving a tobacco taste. Also, the heat conductive material surrounding the tobacco medium section 210 may function as a susceptor heated by the induction coil 130.

The filter section 220 may be a cellulous acetate filter. Shapes of the filter section 220 are not limited. For example, the filter section 220 may be a cylinder-type rod or a tube-type rod having a hollow inside. Also, the filter section 220 may be a recess-type rod. When the filter section 220 includes a plurality of segments, at least one of the plurality of segments may have a different shape.

The filter section 220 may be formed to generate flavors. As an example, a flavored liquid may be sprayed onto the filter section 220 or an additional fiber coated with a flavored liquid may be inserted into the filter section 220.

Also, the filter section 220 may include at least one flavoring capsule 230. However, the at least one flavoring capsule 230 is not limited to the position mentioned above, and may also be included in the tobacco medium section 210. Here, the flavoring capsule 230 may generate a flavor or an aerosol. For example, the flavoring capsule 230 may have a configuration in which a liquid including a flavoring material is wrapped with a film. The flavoring capsule 230 may have a spherical or cylindrical shape, but is not limited thereto. Hereinafter, a method of providing a user with various flavors changing with time by using at least one flavoring capsule 230 will be described in detail with reference to FIGS. 3 through 9.

When the filter section 220 includes a cooling segment cooling an aerosol, the cooling segment may be formed of a polymer material or a biodegradable polymer material. For example, the cooling segment may be manufactured by a process of weaving a bundle of fibers formed of a polymer material or a biodegradable polymer material. The cooling segment may include pure polylactic acid alone, but the material for forming the cooling segment is not limited thereto. Alternatively, the cooling segment may include a cellulose acetate filter having at least one hole. However, the cooling segment is not limited to the above-described example, and any other cooling segments capable of cooling the aerosol may be used.

Hereinafter, an aerosol generating article for providing a user with various flavors without additional inconvenience will be described in detail with reference to FIG. 3.

Figure 3:
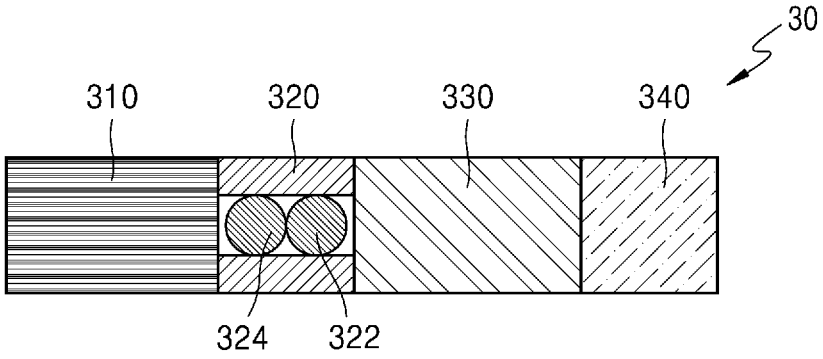
FIG. 3 is a cross-sectional view illustrating an example of an aerosol generating article according to some embodiments.

FIG. 3 is a cross-sectional view illustrating an example of an aerosol generating article according to some embodiments.

FIG. 3 illustrates an example in which the filter section 220 of FIG. 2 includes a first filter segment 320, a cooling segment 330, and a second filter segment 340. For example, the aerosol generating article 30 includes a tobacco medium section 310, the first filter segment 320, the cooling segment 330, and the second filter segment 340.

The first filter segment 320 may be coupled to a downstream end of the tobacco medium section 310. In an example, the first filter segment 320 may be a cellulose acetate filter and may have a hollow inside, but is not limited thereto.

The cooling segment 330 may be coupled to a downstream end of the first filter segment 320. The cooling segment 330 may be formed by a process of weaving a bundle of fibers formed of polylactic acid, or may be formed of a sheet including polylactic acid. However, the cooling segment 330 is not limited thereto, and may be a cellulose acetate filter having a hollow inside. Also, the cooling segment 330 may have at least one perforation formed along an outer surface thereof to enhance a cooling function.

The second filter segment 340 may be coupled to a downstream end of the cooling segment 330. In an example, the second filter segment 340 may be a cellulose acetate tow filter not having a hollow inside, but is not limited thereto.

A plurality of flavoring capsules may be arranged inside at least one of the tobacco medium section 310, the first filter segment 320, the cooling segment 330, and the second filter segment 340. The plurality of flavoring capsules may respectively include different flavor sources and include susceptor materials heated at different rates as an alternating magnetic field passes through the susceptor materials. The plurality of flavoring capsules may burst when heated to a preset temperature by the susceptor materials, and may discharge the flavor sources to the outside. The preset temperature may refer to a temperature at which a surface or film of each of the plurality of flavoring capsules starts to burst.

As the susceptor materials respectively included in the plurality of flavoring capsules are heated at different rates, the plurality of flavoring capsules may reach the preset temperature at different times. As such, the flavor sources are discharged from the plurality of flavoring capsules at different times. As a result, a user may enjoy various flavors changing with time without inconvenience of manually bursting flavoring capsules.

For example, as illustrated in FIG. 3, a first flavoring capsule 322 and a second flavoring capsule 324 may be arranged in a hollow of the first filter segment 320. The first flavoring capsule 322 and the second flavoring capsule 324 may be heated at different heating rates by including different susceptor materials. In detail, as a first susceptor material included in the first flavoring capsule 322 is different from a second susceptor material included in the second flavoring capsule 324 in terms of material, type, density, weight, volume, area, thickness and/or shape thereof, the first susceptor material and the second susceptor material may have different heating rates.

Electro-conductivity may be different according to types of susceptor materials. Also, a susceptor material having high electro-conductivity may be heated at a faster rate than a susceptor material having low electro-conductivity under the same alternating magnetic field. Also, as density of susceptor materials becomes different according to types of susceptor materials, heating rates of susceptor materials having different density may be different from each other.

In addition, the heating rates may become different according to shapes of the susceptor materials. For example, under the same alternating magnetic field, it is experimentally proved that the cylinder-type susceptor material, the plate-type susceptor material, and the particle-type susceptor material have different heating rates, in descending order.

Also, it is experimentally proved that the heating rates of the same type of susceptor material increases as the weight or volume of the susceptor material increases. For example, when two susceptor materials have the same thickness exist, a susceptor material having a larger area may be heated faster than the other one. Also, when two susceptor materials have the same area, a susceptor material having a greater thickness may be heated faster than the other one. Hereinafter, examples of the first flavoring capsule 322 and the second flavoring capsule 324 having different heating rates will be described in more detail with reference to FIGS. 4 through 6.

Figure 4:
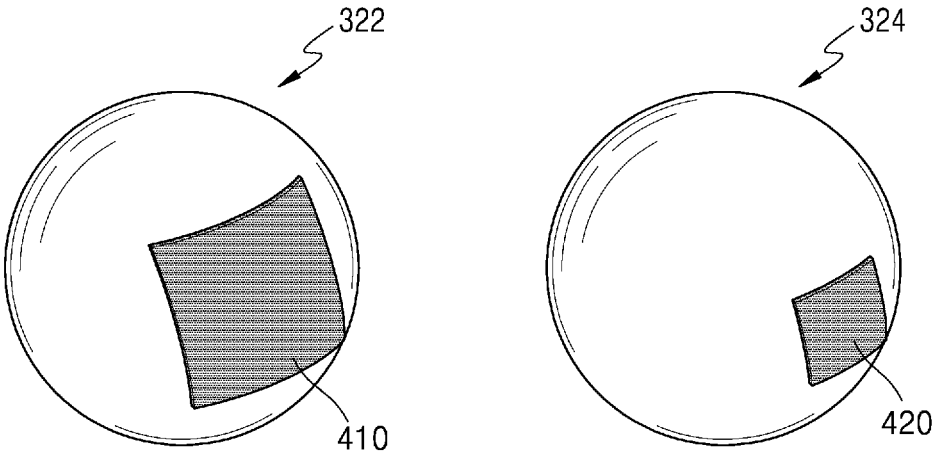
FIGS. 4 through 6 are views illustrating examples of a first flavoring capsule and a second flavoring capsule according to some embodiments.
Figure 5:
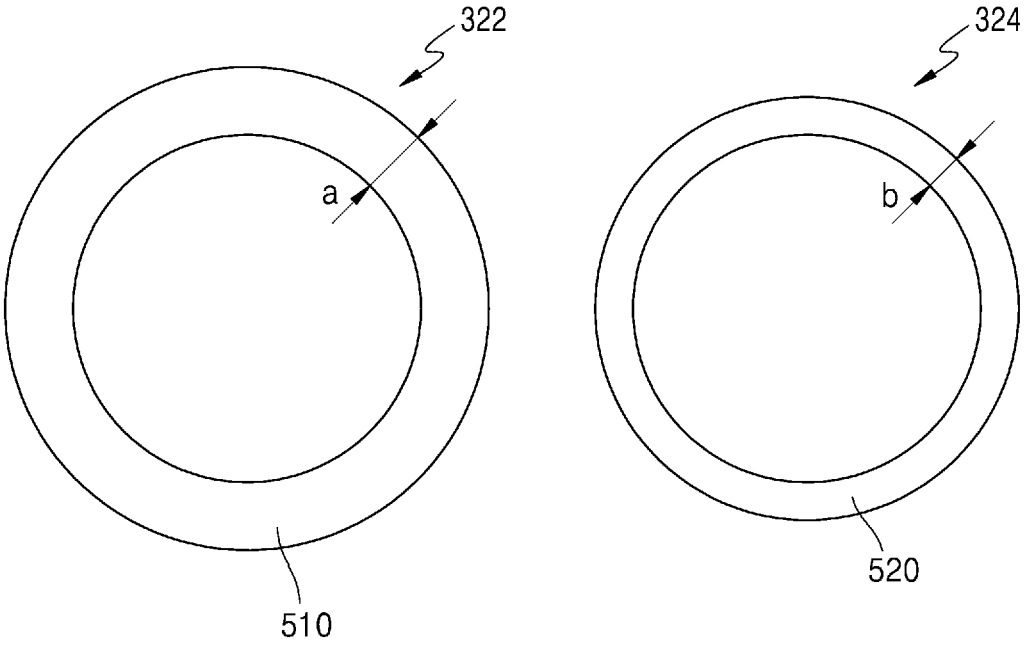
Figure 6:
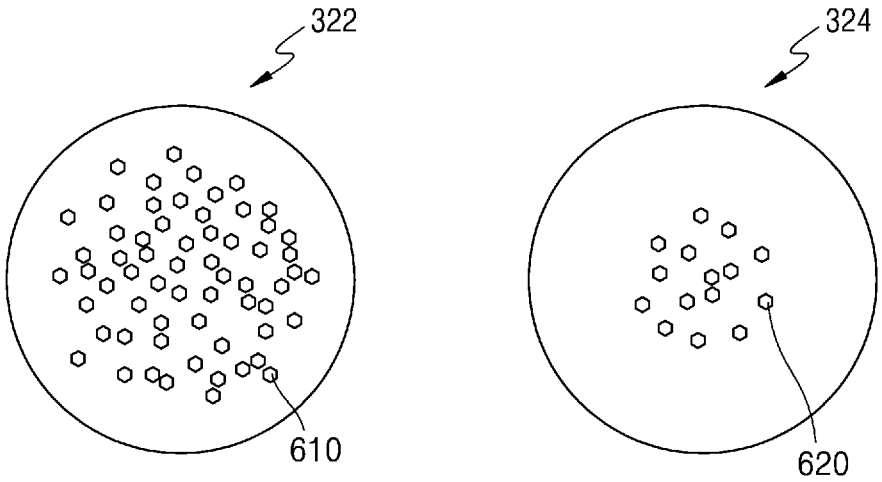

FIGS. 4 through 6 are views illustrating examples of a first flavoring capsule and a second flavoring capsule according to some embodiments.

FIG. 4 is a perspective view illustrating an example of a first flavoring capsule and a second flavoring capsule according to some embodiments.

Referring to FIG. 4, a first flavoring capsule 322 and a second flavoring capsule 324 respectively include susceptor materials coated or applied on at least portions of outer surfaces of the first flavoring capsule 322 and the second flavoring capsule 324. For example, the first flavoring capsule 322 includes a first susceptor material 410 coated or applied on at least a portion of the outer surface of the first flavoring capsule 322, and the second flavoring capsule 324 includes a second susceptor material 420 coated or applied on at least a portion of the outer surface of the second flavoring capsule 324.

Assuming that the first susceptor material 410 and the second susceptor material 420 have the same thickness, an area of the first susceptor material 410 is greater than an area of the second susceptor material 420. Therefore, a heating rate of the first susceptor material 410 may be greater than a heating rate of the second susceptor material 420. Therefore, the surface of the first flavoring capsule 322 may reach a preset temperature by the first susceptor material 410 faster than the surface of the second flavoring capsule 324 reaching the preset temperature by the second susceptor material 420. Thus, the first flavoring capsule 322 may burst and discharge a flavor source before the second flavoring capsule 324.

In an example, when the first flavoring capsule 322 includes a flavor source having a strawberry flavor, and the second flavoring capsule 324 includes a flavor source having a banana flavor, a user may feel merely an aerosol generated from the tobacco medium section 310 from initial smoking for a preset time. However, after a preset time passes, the user may newly feel the strawberry flavor due to bursting of the first flavoring capsule 322. Also, after more time passes, the user may feel a strawberry-banana flavor that is a mixture of the strawberry flavor and the banana flavor, due to bursting of the second flavoring capsule 324. As described above, an aerosol generating article according to the present disclosure includes a plurality of flavoring capsules heated at different heating rates to enable a user to feel various flavors changing with time even without inconvenience of manually bursting the flavoring capsules.

As illustrated in FIG. 4, as the susceptor materials are intensively coated or applied merely on portions of the outer surfaces of the first flavoring capsule 322 and the second flavoring capsule 324, only some portions of the outer surfaces of the first flavoring capsule 322 and the second flavoring capsule 324 may burst. As such, discharge rates or discharge pressure of flavor sources respectively accommodated inside the first flavoring capsule 322 and the second flavoring capsule 324 may increase.

FIG. 5 is a cross-sectional view illustrating another example of a first flavoring capsule and a second flavoring capsule according to some embodiments.

Referring to FIG. 5, a first flavoring capsule 322 and a second flavoring capsule 324 respectively include susceptor materials coated or applied on the entire outer surfaces of the first flavoring capsule 322 and the second flavoring capsule 324. For example, the first flavoring capsule 322 includes a first susceptor material 510 coated or applied on the entire outer surface of the first flavoring capsule 322, and the second flavoring capsule 324 includes a second susceptor material 520 coated or applied on the entire outer surface of the second flavoring capsule 324.

Assuming that the first susceptor material 510 and the second susceptor material 520 have the same area but thickness a of the first susceptor material 510 is greater than thickness b of the second susceptor material 520, a heating rate of the first susceptor material 510 may be greater than a heating rate of the second susceptor material 520. Therefore, the surface of the first flavoring capsule 322 may reach a preset temperature by the first susceptor material 510 faster than the surface of the second flavoring capsule 324 reaching the preset temperature by the second susceptor material 324. Also, the first flavoring capsule 322 may burst and discharge a flavor source before the second flavoring capsule 324. As a result, a user may feel a flavor by the flavor source included in the first flavoring capsule 322 first, and then additionally feel a flavor by a flavor source included in the second flavoring capsule 324.

FIG. 4 illustrates that the susceptor materials 410 and 420 have the same thickness, and FIG. 5 illustrates that the susceptor materials 510 and 520 have the same area. However, these are merely examples. Susceptor materials respectively included in a plurality of flavoring capsules may have different thickness and different area. Here, it will be easily understood by one of ordinary skill in the art that a heating rate of a susceptor material having greater weight or volume may be greater.

FIG. 6 is a cross-sectional view illustrating another example of a first flavoring capsule and a second flavoring capsule according to some embodiments.

Referring to FIG. 6, a first flavoring capsule 322 and a second flavoring capsule 324 respectively include susceptor materials in the form of particles inside the first flavoring capsule 322 and the second flavoring capsule 324. For example, the first flavoring capsule 322 may include a first susceptor material 610 in the form of particles, and the second flavoring capsule 324 may include a second susceptor material 620 in the form of particles.

In this case, the amount of the first susceptor material 610 is greater than the amount of the second susceptor material 620, and thus, a heating rate of the first susceptor material 610 may be greater than a heating rate of the second susceptor material 620. Therefore, the first flavoring capsule 322 may reach a preset temperature by the first susceptor material 610 faster than the second flavoring capsule 324 reaching the preset temperature by the second susceptor material 620. As such, the first flavoring capsule 322 may burst and discharge a flavor source before the second flavoring capsule 324.

Referring to FIG. 3 again, the first flavoring capsule 322 may be arranged further downstream than the second flavoring capsule 324 heated at a lower rate than the first flavoring capsule 322. This is to prevent the flavor source discharged from the first flavoring capsule 322 from affecting heating of the second flavoring capsule 324. However, the position of the first flavoring capsule 322 is not limited to the above-described example, and the first flavoring capsule 322 may be arranged further upstream than the second flavoring capsule 324 that heated at the lower rate than the first flavoring capsule 322. Otherwise, the first flavoring capsule 322 may be arranged parallel with the second flavoring capsule 324 in the same position.

Figure 7:
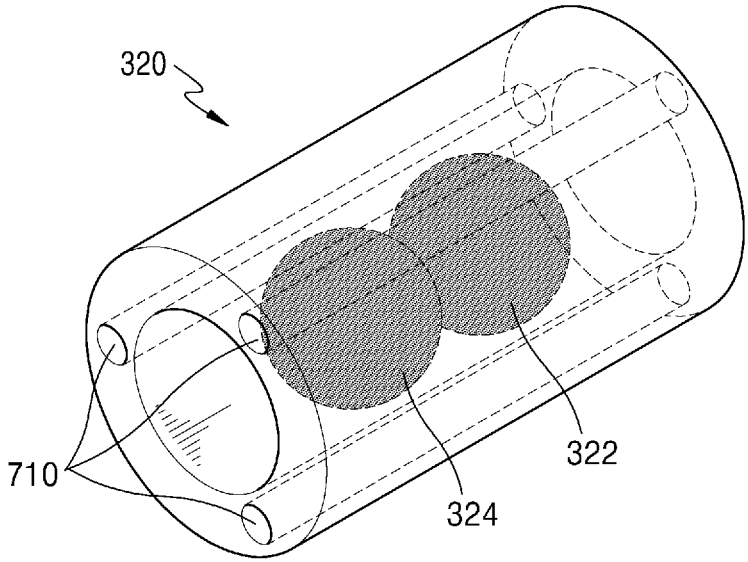
FIG. 7 is a view illustrating an example of a first filter segment according to some embodiments.

FIG. 7 is a view illustrating an example of a first filter segment according to some embodiments.

Referring to FIG. 7, a first filter segment 320 may further include at least one air flow passage 710 extending from the upstream end to the downstream end, in addition to a hollow in which a first flavoring capsule 322 and a second flavoring capsule 324 are arranged. As an air flow in the hollow may be interrupted by the first flavoring capsule 322 and the second flavoring capsule 324, the at least one air flow passage 710 may be used to smooth the air flow and lower draw resistance of the aerosol generating article 30. However, the present disclosure is not limited thereto.

Figure 8:
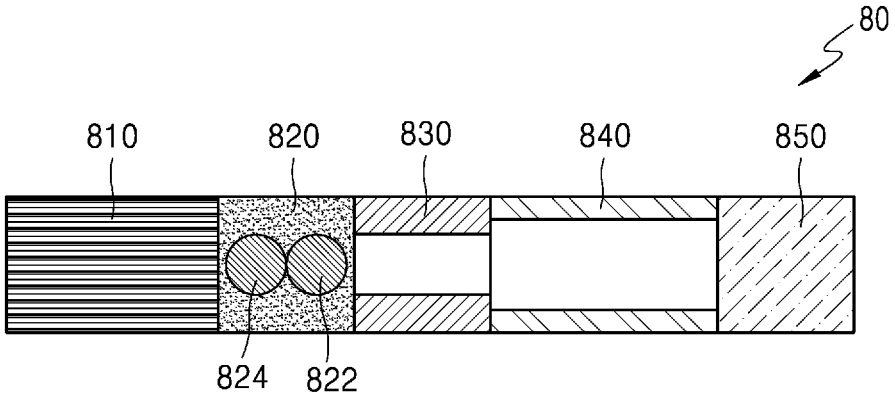
FIG. 8 is a cross-sectional view illustrating another example of an aerosol generating article according to some embodiments.

FIG. 8 is a view illustrating another example of an aerosol generating article according to some embodiments.

FIG. 8 illustrates an example in which the filter section 220 of FIG. 2 includes a first filter segment 820, a second filter segment 830, a cooling segment 840, and a third filter segment 850. For example, the aerosol generating article 80 includes a tobacco medium section 810, the first filter segment 820, the second filter segment 830, the cooling segment 840, and the third filter segment 850.

The first filter segment 820 and the third filter segment 850 may be cellulose acetate tow filters not having hollows inside. However, the first filter segment 820 and the third filter segment 850 are not limited thereto, and may be other appropriate filters capable of filtering a preset component included in an aerosol.

The second filter segment 830 may be coupled to a downstream end of the first filter segment 820 and may include a first hollow inside. The second filter segment 830 may be the same as the first filter segment 320 of FIG. 3, and thus the same descriptions thereof will be omitted herein.

The cooling segment 840 may be coupled to a downstream end of the second filter segment 830, and may include a second hollow having a greater diameter than the first hollow. The cooling segment 840 may be the same as the cooling segment 330 of FIG. 3, and thus the same descriptions thereof will be omitted herein.

As illustrated in FIG. 8, a first flavoring capsule 822 and a second flavoring capsule 824 may be arranged inside the first filter segment 820. However, the first flavoring capsule 822 and the second flavoring capsule 824 are not limited to the above arrangement, and may be arranged inside at least one of the second filter segment 830, the cooling segment 840, and the third filter segment 850. Also, the first flavoring capsule 822 and the second flavoring capsule 824 may not be arranged inside the same segment, and may be respectively arranged in different segments.

As described above with reference to FIGS. 2, 3, and 8, the aerosol generating article 20, 30, or 80 may have various structures. The above-described embodiments are merely for describing effects derived when the aerosol generating article 20, 30, or 80 includes a plurality of flavoring capsules including susceptor materials having different heating temperatures, and are not for limiting the structure of the aerosol generating article 20, 30, or 80. The structure of an aerosol generating article according to the present disclosure is not limited to the above-described embodiments.

Figure 9:
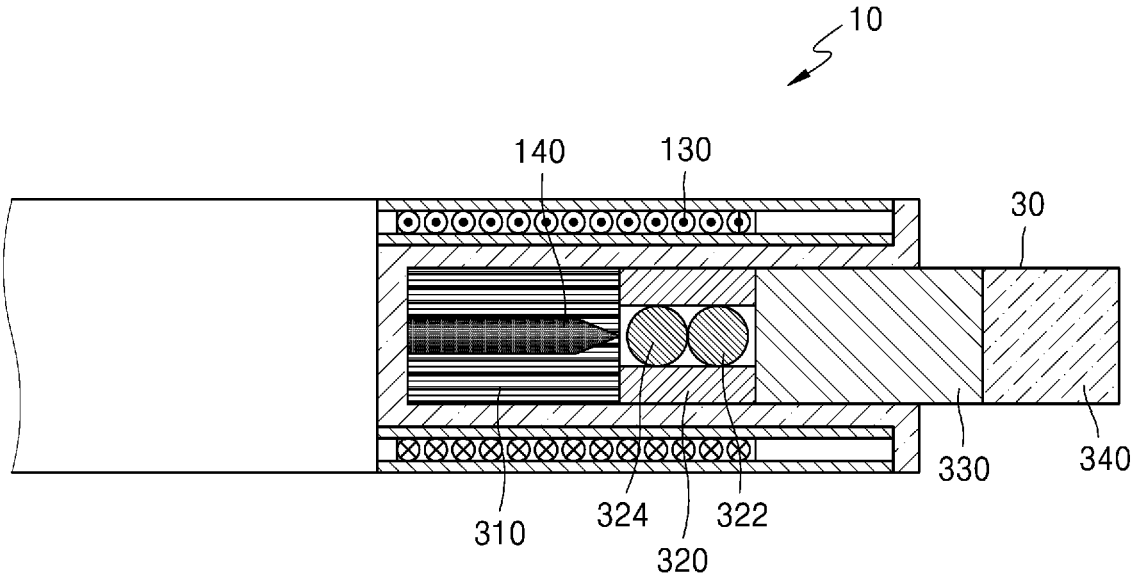
FIG. 9 is a view illustrating an example in which an aerosol generating article is inserted into an aerosol generating device, according to some embodiments.

FIG. 9 is a view illustrating an example in which an aerosol generating article is inserted into an aerosol generating device, according to some embodiments.

FIG. 9 illustrates an example in which the aerosol generating article 30 of FIG. 3 is inserted into an aerosol generating device 10. An induction coil 130 of the aerosol generating device 10 may apply an alternating magnetic field not only to a heater 140 but also to the susceptor materials respectively included in a first flavoring capsule 322 and a second flavoring capsule 324 of the aerosol generating article 30. Therefore, the induction coil 130 may surround the accommodation space 150, extending to a position where the first flavoring capsule 322 and the second flavoring capsule 324 included in the aerosol generating article 30 accommodated in the accommodation space 150 are arranged.

FIG. 9 illustrates an example in which the aerosol generating article 30 of FIG. 3 is inserted into the aerosol generating device 10. However, the aerosol generating article 20 of FIG. 2, the aerosol generating article 80 of FIG. 8, and aerosol generating articles having structures different than in the above-described embodiments may be inserted into the aerosol generating device 10. FIG. 9 illustrates an example in which the first flavoring capsule 322 and the second flavoring capsule 324 are arranged in the first filter segment 320, and the induction coil 130 extends to surround the first filter segment 320. However, the first flavoring capsule 322 and the second flavoring capsule 324 may be arranged in different segments, and, in this case, the induction coil 130 may extend to surround portions where the first flavoring capsule 322 and the second flavoring capsule 324 are arranged.

FIGS. 3 through 9 illustrate examples of an aerosol generating article including two flavoring capsules, but those are merely examples for convenience of description. The number of flavoring capsules may be three or more. In this case, more various flavors may be provided to a user than when there are two flavoring capsules. Each of three or more flavoring capsules may be arranged in at least one of a plurality of segments included in an aerosol generating article, and may include susceptor materials heated at different rates, thereby discharging flavor sources at different time points.

Those of ordinary skill in the art related to the present embodiments may understand that various changes in form and details can be made therein without departing from the scope of the characteristics described above. The disclosed methods should be considered in a descriptive sense only and not for purposes of limitation. Therefore, the scope of the disclosure should be defined by the appended claims rather than by the above descriptions, and all differences within the scope equivalent to those described in the claims will be construed as being included in the present disclosure.

What is claimed is:

1. An aerosol generating article comprising:

a tobacco medium section;

a filter section coupled to a downstream end of the tobacco medium section; and a plurality of flavoring capsules arranged inside at least one of the tobacco medium section and the filter section, wherein the plurality of flavoring capsules comprise:

a first flavoring capsule comprising a first flavor source and a first susceptor material; and a second flavoring capsule comprising a second flavor source different from the first flavor source, and a second susceptor material that is configured to be heated at a different rate than a heating rate of the first susceptor material as an alternating magnetic field passes through the first susceptor material and the second susceptor material, and wherein the first flavoring capsule and the second flavoring capsule are configured to be heated at different rates from each other based on including the first susceptor material and the second susceptor material, respectively.

2. The aerosol generating article of claim 1, wherein the first susceptor material, included in the first flavoring capsule, is in a different form from the second susceptor material, included in the second flavoring capsule, in terms of at least one of type, density, weight, volume, area, thickness, and shape, such that the first susceptor material and the second susceptor material have different heating rates.

3. The aerosol generating article of claim 1, wherein the first susceptor material and the second susceptor material are coated or applied on at least a portion of outer surfaces of the first flavoring capsule and the second flavoring capsule, respectively.

4. The aerosol generating article of claim 1, wherein the first susceptor material and the second susceptor material are particles inside the first flavoring capsule and the second flavoring capsule, respectively.

5. The aerosol generating article of claim 1, wherein the first flavoring capsule and the second flavoring capsule are configured to burst and discharge the first flavor source and the second flavor source, respectively, when heated to a preset temperature or greater by the first susceptor material and the second susceptor material, respectively.

6. The aerosol generating article of claim 1, wherein the first flavoring capsule is arranged further downstream than the second flavoring capsule, and the second flavoring capsule has a lower heating rate than the first flavoring capsule.

7. The aerosol generating article of claim 1, wherein the filter section comprises:

a first filter segment including a hollow inside;

a cooling segment coupled to a downstream end of the first filter segment; and a second filter segment coupled to a downstream end of the cooling segment, wherein at least one of the plurality of flavoring capsules is arranged in the hollow of the first filter segment.

8. The aerosol generating article of claim 7, wherein the first filter segment further includes at least one air flow passage penetrating from an upstream end of the first filter segment to the downstream end, in addition to the hollow in which the at least one of the plurality of flavoring capsules is arranged.

9. The aerosol generating article of claim 1, wherein the filter section comprises:

a first filter segment including cellulose acetate tow;

a second filter segment coupled to a downstream end of the first filter segment and including a first hollow inside;

a cooling segment coupled to a downstream end of the second filter segment and including therein a second hollow having a greater diameter than the first hollow; and a third filter segment coupled to a downstream end of the cooling segment, wherein at least one of the plurality of flavoring capsules is arranged inside the first filter segment.

10. An aerosol generating device comprising:

the aerosol generating article of claim 1;

an accommodation space that accommodates the aerosol generating article;

an induction coil arranged to surround at least a portion of the accommodation space;

a battery configured to supply power to the induction coil to enable the induction coil to generate the alternating magnetic field; and a heater arranged at an inner end of the accommodation space and configured to heat up as the alternating magnetic field generated from the induction coil passes through the heater.

11. The aerosol generating device of claim 10, wherein the induction coil surrounds the accommodation space, extending to a position where the plurality of flavoring capsules included in the aerosol generating article accommodated in the accommodation space are arranged.

* * * * *